US009549277B2

(12) United States Patent
Corteel et al.

(10) Patent No.: US 9,549,277 B2
(45) Date of Patent: Jan. 17, 2017

(54) METHOD FOR EFFICIENT SOUND FIELD CONTROL OF A COMPACT LOUDSPEAKER ARRAY

(75) Inventors: Etienne Corteel, Malakoff (FR); Matthias Rosenthal, Dielsdorf (CH); Khoa-Van Nguyen, Paris (FR)

(73) Assignee: SoniceMotion AG, Oberglatt (CH)

( * ) Notice: Subject to any disclaimer, the term of this patent is extended or adjusted under 35 U.S.C. 154(b) by 496 days.

(21) Appl. No.: 14/116,946

(22) PCT Filed: Apr. 25, 2012

(86) PCT No.: PCT/EP2012/057581
§ 371 (c)(1),
(2), (4) Date: Dec. 6, 2013

(87) PCT Pub. No.: WO2012/152588
PCT Pub. Date: Nov. 15, 2012

(65) Prior Publication Data

US 2014/0098966 A1 Apr. 10, 2014

(30) Foreign Application Priority Data

May 11, 2011 (EP) ..... 11165720

(51) Int. Cl.
*H04S 7/00* (2006.01)
*H04R 3/12* (2006.01)

(52) U.S. Cl.
CPC ..... *H04S 7/301* (2013.01); *H04R 3/12* (2013.01); *H04S 2420/13* (2013.01)

(58) Field of Classification Search
CPC ..... H04S 2420/13; H04S 7/301; H04R 3/12
See application file for complete search history.

(56) References Cited

U.S. PATENT DOCUMENTS

2004/0223620 A1* 11/2004 Horbach ..... H04R 29/002 381/59

* cited by examiner

*Primary Examiner* — Ping Lee
(74) *Attorney, Agent, or Firm* — Edwin D. Schindler

(57) ABSTRACT

A method for optimizing the design and sound field control of a compact loud-speaker array, which includes a plurality of loudspeakers located on a closed loudspeaker surface and the control of the emitted sound field by the loudspeakers within a limited reproduction subspace, having the steps of capturing the sound field using a plurality of microphones and adjusting filter coefficients that modify the alimentation signals of the loudspeakers to minimize the difference between reproduced signals captured by the microphones and target signals describing a target sound field. A conical reproduction surface encloses a reproduction subspace is defined such that the apex of the conical reproduction surface is within the closed loudspeaker surface. Loudspeakers are positioned on a limited loudspeaker surface and the closed loudspeaker surface. The microphones are located on a limited microphone surface defined by the intersection of the inner volume of the conical reproduction subspace and the closed microphone surface.

9 Claims, 9 Drawing Sheets

PRIOR ART

METHOD FOR EFFICIENT SOUND FIELD CONTROL OF A COMPACT LOUDSPEAKER ARRAY

The invention relates to a method for controlling the sound field emitted by a compact loudspeaker array. Sound field control can be applied to several fields such as noise reduction, sound field reproduction or directivity control.

DESCRIPTION OF STATE OF THE ART

Sound field control consists in modifying the loudspeaker's alimentation signals of a given loudspeaker array in order to minimize a reproduction error (difference between the sound field radiated and a target).

All sound field control methods having a partition of space into two subspaces:

- reproduction subspace where the target sound field should be synthesized $\Omega_R$,
- loudspeaker/source subspace $\Omega_S$ where all loudspeakers and sources at the origin of the target sound field are located.

The control is usually achieved on a limited number of microphones positioned on the boundary $\partial\Omega$ of $\Omega_R$ and $\Omega_S$ aiming at controlling the synthesized sound field within the entire reproduction subspace $\Omega_R$.

There exist two categories of sound field control:

- interior sound field control (finite size control subspace surrounded by "infinite" loudspeaker/source subspace)
- exterior sound field control (finite size loudspeaker/source subspace surrounded by "infinite" control subspace).

Interior sound field control is a classical case for sound field reproduction using loudspeakers surrounding a listening area. However, compact loudspeaker array sound field control is more easily described with exterior sound field reproduction.

Existing methods of sound field control with compact loudspeaker arrays generally consider loudspeakers set in a spherical like baffle that often takes the shape of a regular polyhedron where each face contains one or more loudspeakers.

Such systems either target the synthesis of elementary radiation patterns such as spherical harmonics as disclosed by Warusfel, O., Corteel, E. Misdariis, N. and Caulkins, T. in "Reproduction of sound source directivity for future audio applications", ICA-International Congress on Acoustics, Kyoto (2004) or the synthesis of complex sound fields for noise reduction as disclosed by Rafaely, B. in "Spherical loudspeaker array for local active control of sound" Journal of the Acoustical Society of America, 125(5):3006-3017, May 2009.

Figure 1:
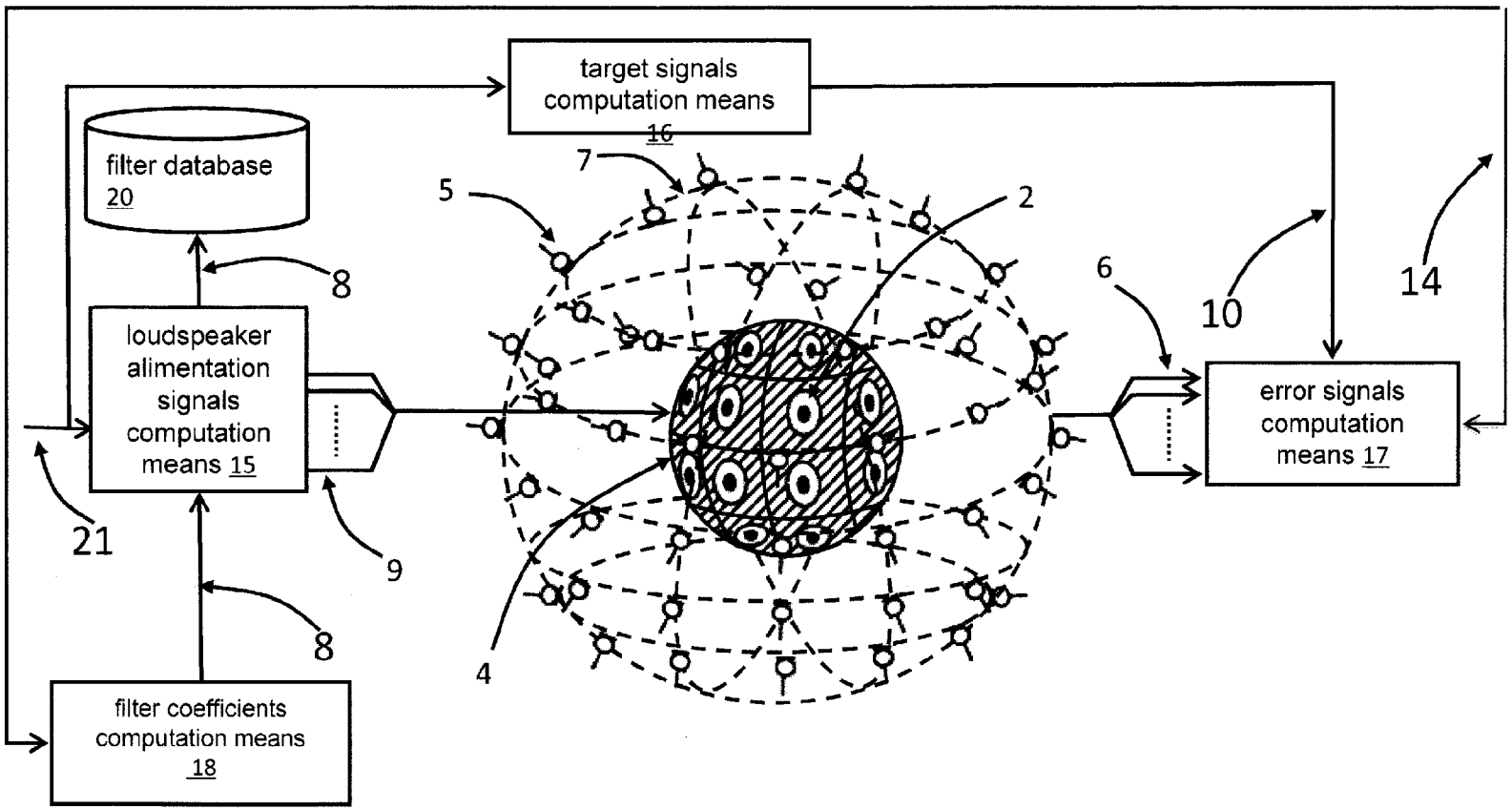
PRIOR ART FIG. 1

A method according to state of the art is presented in FIG. 1. A plurality of loudspeakers 2 are arranged as a compact loudspeaker array 19 of spherical shape. Loudspeaker alimentation signals 9 are computed from a first audio input signal 21 and first filter coefficients 8 using loudspeaker alimentation signals computation means 15. The loudspeakers 2 emit a sound field 1 that is captured by a plurality of first microphones 5 covering a microphone surface 7 of spherical shape that encloses the compact loudspeaker array 19 creating reproduced signals 6. These reproduced signals 6 are compared to target signals 10 forming error signals 14 using error signals computation means 17. The target signals 10 are computed from first audio input signals 21 using target signal computation means 16. The error signals 14 are used to compute filter coefficients 8 so as to minimize the reproduction error. Additionally filter coefficients may be stored in a filter database 20 that comprises filter coefficients 8 optimized for the synthesis of a plurality of target sound fields 11. These filters can thus be used later on for the synthesis of one or several target sound fields 11 from one or several audio input signals 21 using the compact loudspeaker array 19.

There exist two types of sound field control methods:

- model-based control
- measurement based control

The model-based techniques consist in describing both the loudspeaker array radiation characteristics and the target sound field into Eigen solutions of the wave equation in 3 dimensions. Using the orthonormality property of such solutions, filters can be calculated to synthesize elementary sound fields corresponding to the Eigen solutions of the wave equation that can later be combined to form more complex sound fields. For spherical type loudspeaker arrays, the adapted coordinate system is the spherical coordinate system. The Eigen solutions are thus spherical harmonics. As disclosed by Zotter, F. and Höldrich, R. in "Modelling radiation synthesis with spherical loudspeaker arrays", 19th International Conference on Acoustics, Madrid, Spain (2007), the radiation of individual loudspeakers set in a rigid spherical baffle can be easily described into spherical harmonics. The model accounts for the scattering properties of the rigid sphere considering the loudspeakers as rigid spherical caps with controlled normal velocity. This model can later be used to design control filters in order to synthesize radiation beams as disclosed by Zotter, F. and Noisternig, M. in "Near- and Far-Field beamforming using spherical loudspeaker arrays", 3rd Congress of the Alps Adria Acoustics Association, Graz, Austria (2007).

Another class of Eigen solutions are given by acoustic radiation modes of spheres as disclosed by Pasqual, A. M., Arruda, J. R., and Herzog, P. "Application of Acoustic Radiation Modes in the Directivity Control by a Spherical Loudspeaker Array", Acta Acustica united with Acustica, 96, (2010).

Models are attractive because they do not require any complicated and time-consuming measurement of the loudspeaker array. However, they suffer from several drawbacks. First, only simple loudspeaker array shapes, such as spheres, can be efficiently modeled. Second, as already mentioned, practical realizations of spherical arrays have the shape of polyhedron, not spheres. Third, loudspeakers are modeled as spherical caps, which does not correspond to the shape of standard electrodynamics cone drivers. Finally, loudspeaker membranes are generally not perfectly rigid and exhibit complex radiation modes, especially at high frequencies. All these simplifications limit the precision and the usability of such models in practical situations.

Measurement based solutions consist in measuring the free field radiation of each individual loudspeaker of the compact array on a surface enclosing the loudspeaker array. This solution is disclosed by Warusfel, O., Corteel, E. Misdariis, N. and Caulkins, T. in "Reproduction of sound source directivity for future audio applications", ICA-International Congress on Acoustics, Kyoto (2004). Practical implementations of this solution consider a spherical surface concentric to a pseudo-spherical loudspeaker array having the shape of a cube. The filters are obtained by minimizing the error between the synthesized sound field measured by a distribution of omnidirectional microphones on a spherical grid and the target sound field expressed at the microphone positions by projecting the error term onto the individual radiation pattern of the loudspeakers. A similar technique consists in describing the loudspeaker/microphone system as a MIMO (Multi-Input Multi-Output) system and using pseudo-inversion techniques to calculate the filters as disclosed by F. Zotter in "Analysis and Synthesis of Sound-Radiation with Spherical Arrays", PhD thesis, Institute of Electronic Music and Acoustics, University of Music and Performing Arts, 2009.

As disclosed by F. Zotter in "Analysis and Synthesis of Sound-Radiation with Spherical Arrays", PhD thesis, Institute of Electronic Music and Acoustics, University of Music and Performing Arts, 2009, the sound field can efficiently be controlled up to a corner frequency that depends on the loudspeakers and the microphones spacing. This limitation is usually referred to as spatial aliasing and results from the spatial under-sampling of the loudspeaker (resp. microphone) discrete distribution on the loudspeaker (resp. microphone) surface.

The main drawbacks of measurement-based techniques are the required time and the complexity of the measurement system. A full 3D measurement requires a large number of microphones spanning either a portion or the entire spherical surface enclosing the compact loudspeaker array. For example, F. Zotter describes in "Analysis and Synthesis of Sound-Radiation with Spherical Arrays", PhD thesis, Institute of Electronic Music and Acoustics, University of Music and Performing Arts, 2009, a measurement system comprising a microphone array spanning a half circle that is rotated around a compact loudspeaker array for simulating a full sphere free field radiation measurement in an anechoic chamber using a limited number of physical microphones.

This requires either a very large number of measurement microphones (up to several hundreds) or a large measurement setup time. Such requirements make these approaches largely impractical for practical large scale applications.

Another drawback of the state of the art is to rely on full 3D space, i.e. providing a control that can be performed in any direction or location of space. However, it is often sufficient to concentrate on a finite subspace where control is most important for the application. In sound reproduction, such a subspace can be for example the horizontal plane where listeners are located. This subspace can also span an arbitrary shaped reduced portion of space where noise reduction has to be achieved or sound level has to be concentrated.

Methods for limiting the number of active loudspeakers for the synthesis of a target sound field have been disclosed and will be presented in the following. However, these methods are only applicable to the interior problem of sound reproduction.

One of such methods is referred to as Wave Field Synthesis (WFS). WFS is a sound field rendering method that was proposed to solve the interior sound field rendering problem. It is based on the Kirchhoff-Helmholtz integral. The Kirchhoff-Helmholtz integral provides an exact description of a sound field within a finite size reproduction subspace $\Omega_R$ by its pressure and its pressure gradient distribution on the boundary surface $\partial\Omega$ of $\Omega_R$. The only assumption is that the sound sources that create the target sound field are all located in the subspace $\Omega_S$ defined as the complementary subspace of $\Omega_R$. The Kirchhoff-Hemholtz also provides an exact solution to the interior problem using a continuous distribution of monopoles (resp. dipoles) driven by the pressure gradient (resp. pressure) of the target sound field. Using this dual layer distribution of so-called secondary sources the target sound field is perfectly synthesized within $\Omega_R$ and a null sound field is synthesized in $\Omega_S$.

WFS is disclosed by R. Nicol in « Restitution sonore spatialisée sur une zone étendue: application à la téléprésence» , Ph.D. thesis, Université du Maine, Le Mans, France, 1999 as a number of approximations of the Kirchhoff-Helmholtz integral for the synthesis of a target virtual sound source:

- approximation 1: reduction of the secondary source surface to a linear distribution in the horizontal plane,
- approximation 2: selection of monopole secondary sources only,
- approximation 3: selection of relevant loudspeakers using visibility criteria,
- approximation 4: sampling of the continuous distribution to a finite number of aligned loudspeakers, Approximation 1 results from the assumption that virtual sources and listeners are both located in a given horizontal plane. Approximation 2 and 3 are made from a simple analysis of the contribution of secondary sources where:

1. the contributions of monopoles and dipoles are in phase (relevant secondary sources),
2. the contributions of monopoles and dipoles are out of phase (irrelevant secondary sources) and tend to compensate for each other, The sound fields emitted by the monopoles and the dipoles have mostly similar spatio-temporal characteristics. However, relevant monopoles and relevant dipoles are in phase and tend to produce only double sound pressure level in $\Omega_R$ whereas irrelevant monopoles and irrelevant dipoles are out of phase and only tend to compensate for each other in $\Omega_R$. Therefore, only relevant monopoles could be used for the synthesis of the target sound field in $\Omega_R$. The difference to the ideal formulation is that the sound field is no longer null in $\Omega_S$.

Figure 2:
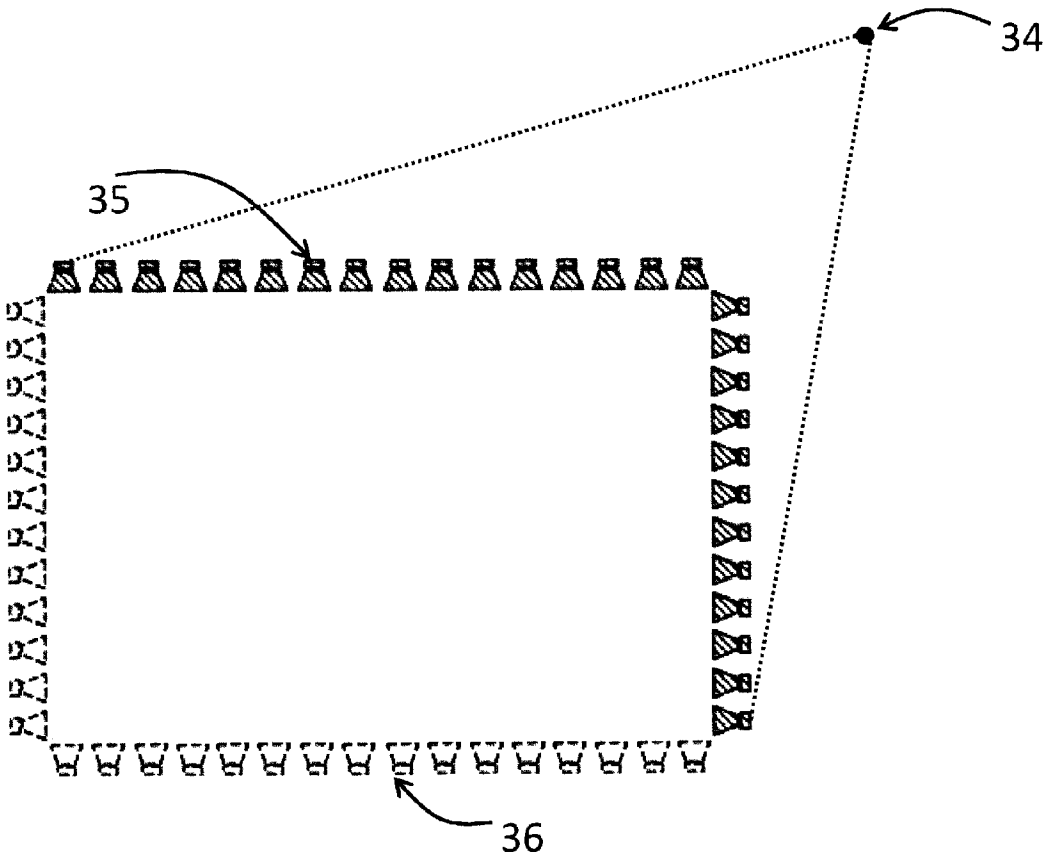
PRIOR ART FIG. 2

Most commercial loudspeakers tend to exhibit omnidirectional directivity characteristics, at least at low frequencies, and are usually considered as monopoles. The discrimination of relevant loudspeakers 35 towards irrelevant loudspeakers 36 for the synthesis of a target virtual sound source 34 using WFS can be made using simple geometrical criteria and is illustrated in FIG. 2. The relevant loudspeakers 35 are the ones that point back to the virtual source 34.

A method for the control of sound fields in the context of Wave Field Synthesis is disclosed by Corteel, E. in "Equalization in extended area using multichannel inversion and Wave Field Synthesis", Journal of the Audio Engineering Society, 54, (2006). This method enables the control of the free field radiation of a pseudo-linear loudspeaker array in the horizontal plane using only a linear array of microphones located at a typical reference distance from the loudspeaker array. A particular aspect of the method is the selection of loudspeakers and/or microphones using visibility criteria.

Figure 3:
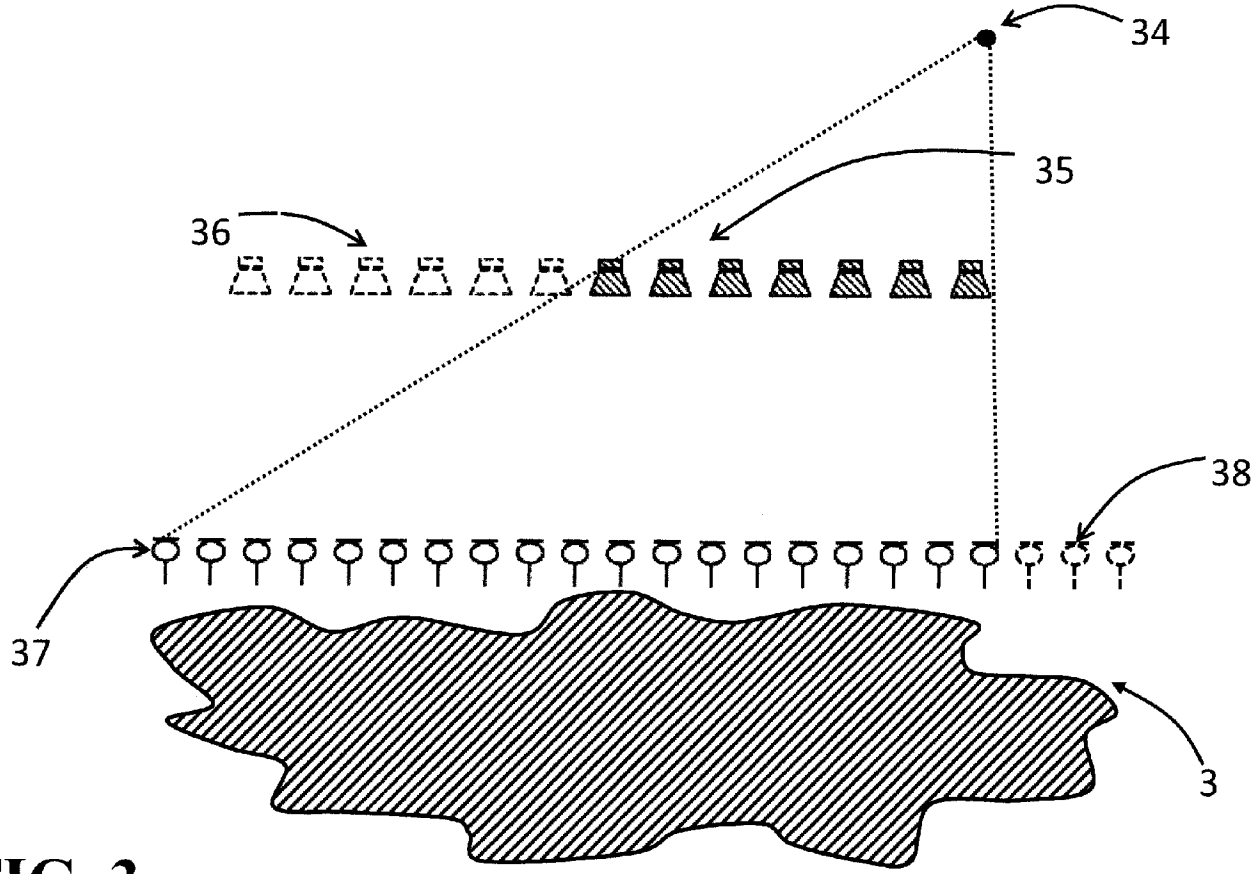

The method disclosed by Corteel, E. in "Equalization in extended area using multichannel inversion and Wave Field Synthesis", Journal of the Audio Engineering Society, 54, (2006) expands the loudspeaker selection method based on visibility criteria to loudspeaker and microphone selection for sound field control of a linear array of loudspeakers having non ideal directivity characteristics. The loudspeaker and microphone selection method is illustrated in FIG. 3. Relevant 35 and irrelevant loudspeakers 36 required for the synthesis of a target virtual sound source 34 are selected using simple visibility criteria accounting for the finite size of the limited reproduction subspace 3 (portion of the horizontal plane for WFS rendering). Relevant 37 and irrelevant microphones 38 are selected using similar visibility criteria of visibility of microphones through the window created by the relevant loudspeakers 35.

As disclosed by Corteel, E. in "Equalization in extended area using multichannel inversion and Wave Field Synthesis", Journal of the Audio Engineering Society, 54, (2006), the method allows for an efficient control of the sound field within the entire reproduction subspace for the specific case of virtual source rendering using WFS. However, the drawback of this method is that it is only described for Wave Field Synthesis rendering (i.e. interior problem in the horizontal plane only).

AIM OF THE INVENTION

The aim of the invention is to provide means to simplify the procedures for sound field control with compact loudspeaker array accounting for the fact that control might often be accurate in a portion of space only. It is another aim of the invention to reduce the number of required loudspeakers and therefore reducing cost of the loudspeaker array. It is another of the invention to additionally reduce the number of microphones for limiting cost and time required for capturing the emitted sound field by the loudspeaker array.

SUMMARY OF THE INVENTION

The invention consists in a method for efficient sound field control of a compact loudspeaker array over a limited reproduction subspace reducing the amount of required loudspeakers and microphones. The method presented here consists in defining a closed loudspeaker (resp. microphone) surface of arbitrary shape on which loudspeakers (resp. microphones) should be positioned such that the loudspeaker surface is positioned in the interior subspace of the microphone surface (exterior sound field control). The second step of the method consists in further defining a control subspace in which the sound field synthesized by the loudspeaker array should be controlled. The third step of the method consists in selecting, using visibility criteria, portions of the loudspeaker and microphone surface that are sufficient to realize an efficient control of the synthesized sound field within the limited reproduction subspace. The fourth step consists in creating a loudspeaker array where a plurality of loudspeakers are positioned on the visible portion of the loudspeaker surface and to capture the free field radiation of these loudspeakers using a microphone array that spans the visible portion of the microphone surface in order to describe the sound field synthesis as a MIMO system. Finally, filter coefficients are calculated so as to minimize the reproduction error between the target sound field and the synthesized sound field captured by the microphones.

The first steps of the method allow for a precise control of the free field radiation of the compact loudspeaker array in a limited reproduction subspace. However, in applications like sound reproduction, the compact loudspeaker array may radiate in a closed reflective environment and the full acoustic power radiation may affect the perceptual quality of the reproduced sound field for a human listener. These additional contributions may particularly affect the perception of timbre and should be compensated for.

Therefore, the method may comprise additional steps for the optimization of filter coefficients by evaluating the sound power radiated by the compact loudspeaker array in a reflective environment. This acoustic power may be either estimated using a model or measured in a real environment using additional microphones. Based on this measurement, the acoustic power is compared to a target and compensation filter coefficients are computed. These compensation filter coefficients are then used to modify the first filter coefficients and create second filter coefficient that account for the acoustic power radiated by the compact loudspeaker array for the synthesis of the target sound field.

In other words, there is presented here a method for optimizing the design of a compact loudspeaker array comprising a plurality of loudspeakers located on a closed loudspeaker surface, and the control of the emitted sound field by said loudspeakers within a limited reproduction subspace. The method comprises steps of capturing said sound field using a plurality of first microphones and adjusting first filter coefficients that modify the alimentation signals of said loudspeakers so as to minimize the difference between reproduced signals captured by said first microphones and target signals describing a target sound field.

Therefore, a conical reproduction surface enclosing the reproduction subspace is defined such that the apex of said conical reproduction surface is comprised within the closed loudspeaker surface. Then, a closed microphone surface is chosen such that it comprises the apex of the conical reproduction surface and the closed loudspeaker surface. Loudspeakers are thus substantially positioned on a limited loudspeaker surface defined by the intersection of the inner volume of the conical reproduction surface and the closed loudspeaker surface. Finally, a plurality of first microphones is arranged such that they are substantially located on a limited microphone surface defined by the intersection of the inner volume of the conical reproduction surface and the closed microphone surface.

Furthermore, the method may comprise steps wherein the reproduced signals are obtained with a physical measurement aiming at capturing the free field radiation of the loudspeakers. And the method may also comprises steps

- wherein the reproduced signals are obtained using a model aiming at characterizing the free field radiation of the loudspeakers.
- wherein first microphones are arranged so as to provide an accurate description of said sound field in said limited reproduction subspace up to a corner frequency.
- wherein loudspeakers are arranged so as to provide an accurate synthesis of said sound field in said limited reproduction subspace up to a corner frequency.

Moreover, the invention may comprise steps wherein the first filter coefficients may be modified by accounting for the acoustic power radiated by the compact loudspeaker array for the synthesis of the target sound field forming second filter coefficients. Furthermore the method may comprise steps wherein the radiated acoustic power radiated by the compact loudspeaker array for the synthesis of the target sound field is estimated by positioning the loudspeaker array in a reflective environment and capturing reproduced signals in reflective environment with a plurality of second microphones. And the method may also comprises steps:

- wherein the estimated acoustic power radiated by the compact loudspeaker array for the synthesis of the target sound field is estimated using a model of the radiation of the compact loudspeaker array.
- wherein the second filter coefficients are obtained by applying acoustic power correction filter coefficients to first filter coefficients.
- wherein the acoustic power correction filter coefficients are obtained by comparing the estimated acoustic power radiated by the compact loudspeaker array for the synthesis of the target sound field to an estimate of the acoustic power of the target sound field.

The invention will be described with more detail hereinafter with the aid of examples and with reference to the attached drawings, in which FIG. 1 describes a sound field control method according to state of the art.

FIG. 2 describes a loudspeaker and microphone selection method according to state of the art.

FIG. 3 describes a loudspeaker selection method for Wave Field Synthesis sound reproduction.

Figure 4:
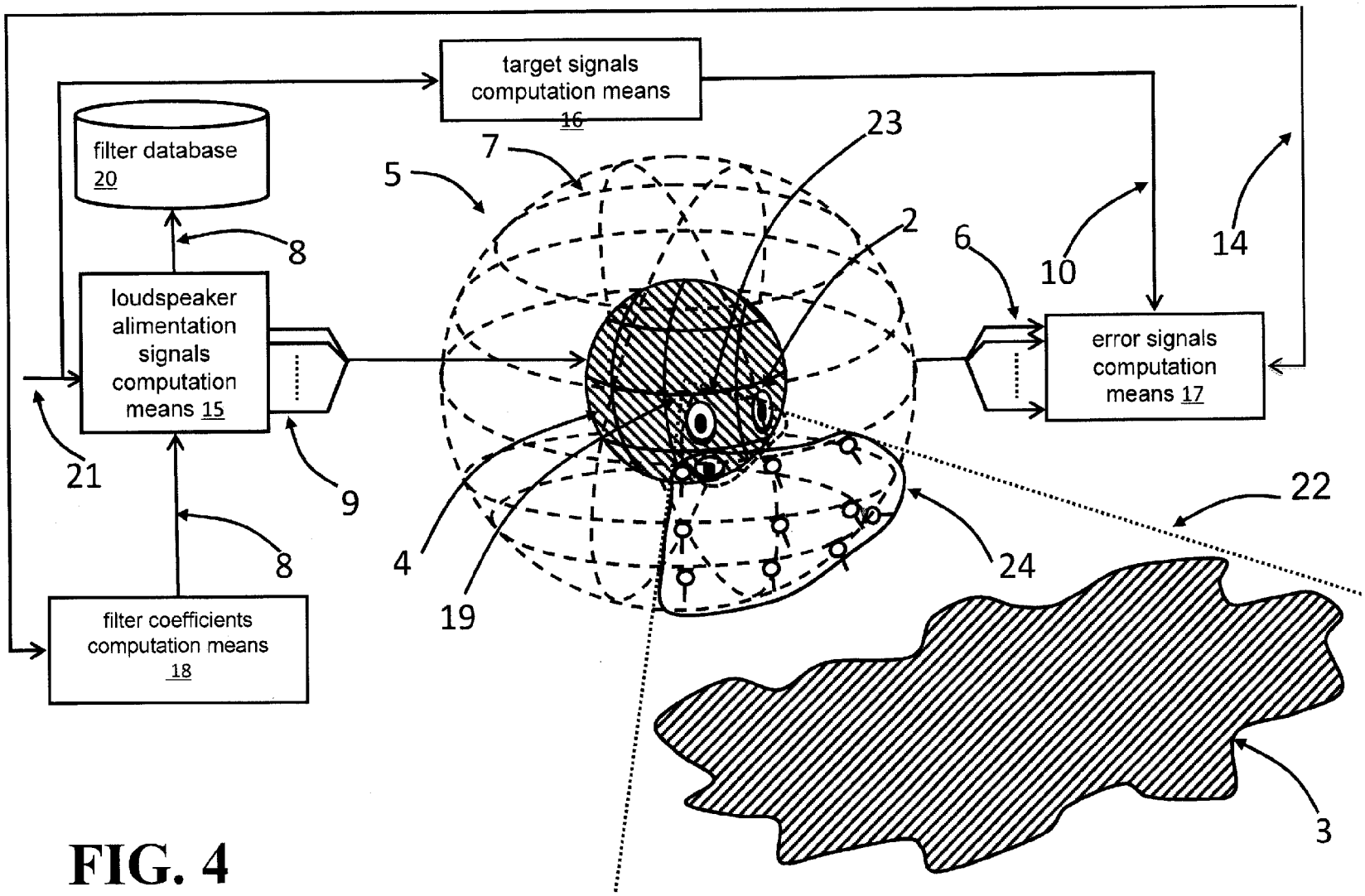

FIG. 4 describes a modified sound field control method according the invention.

Figure 5:
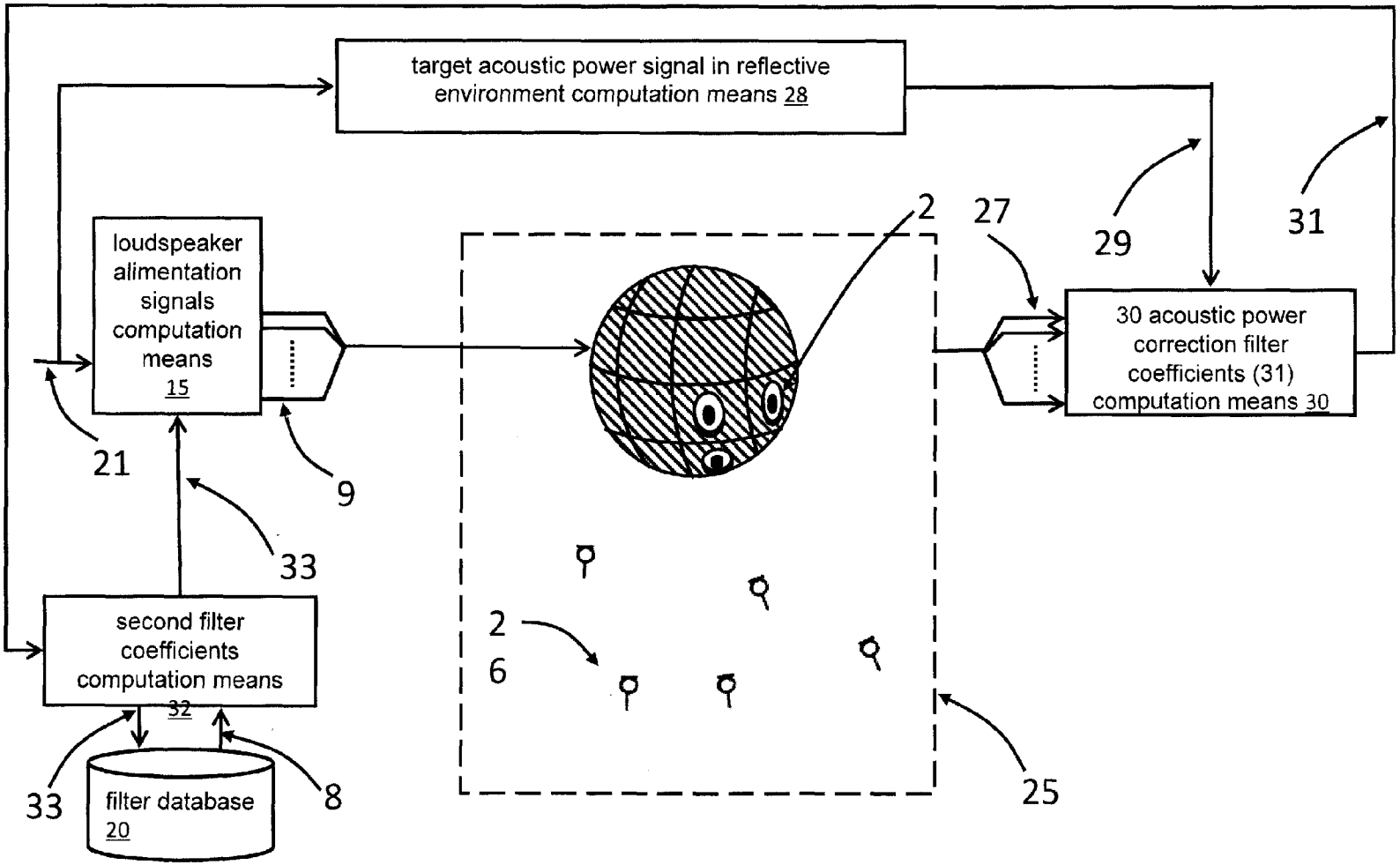

FIG. 5 describes an optional second sound field control method according the invention.

Figure 6:
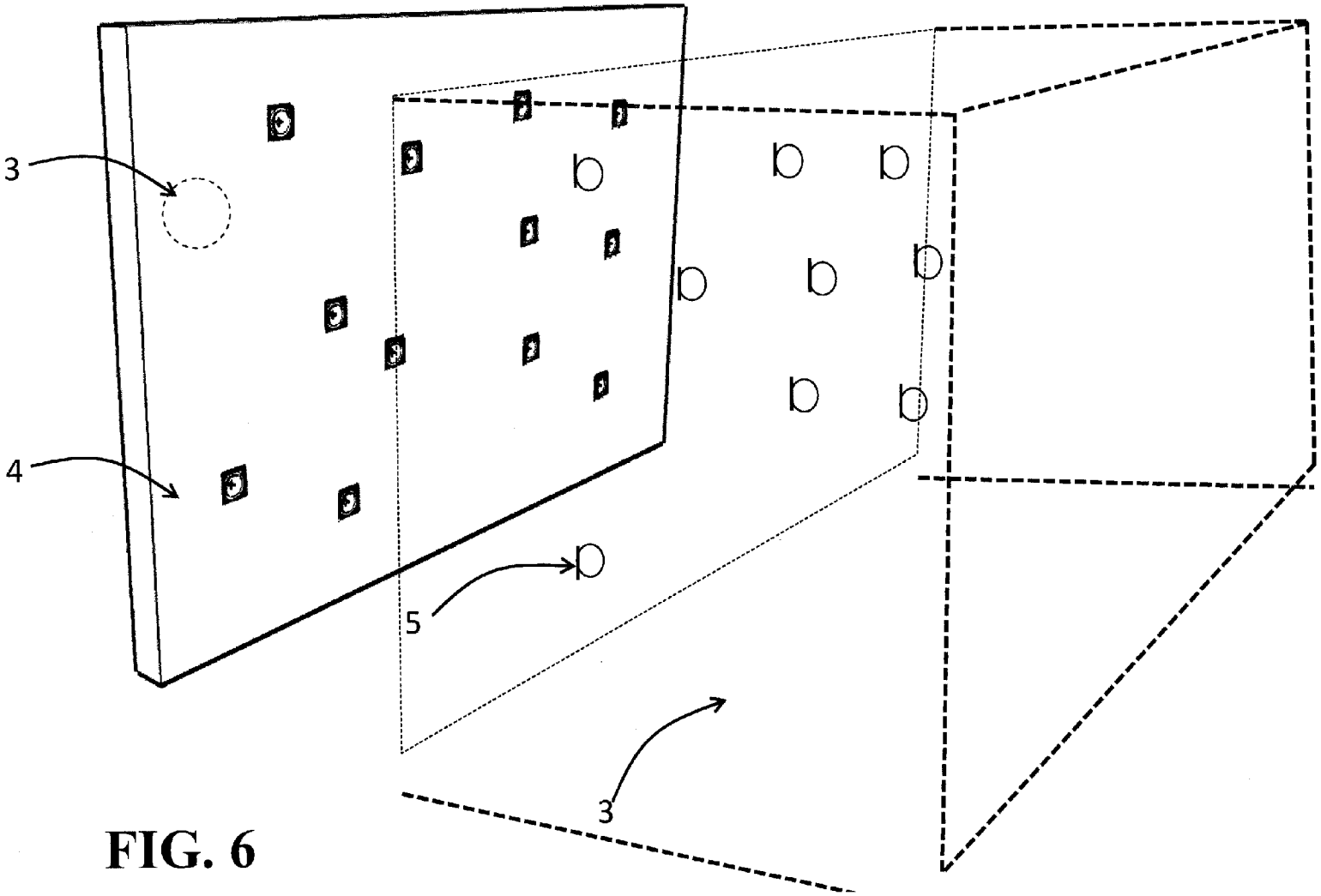

FIG. 6 describes first embodiment according to the invention.

Figure 7:
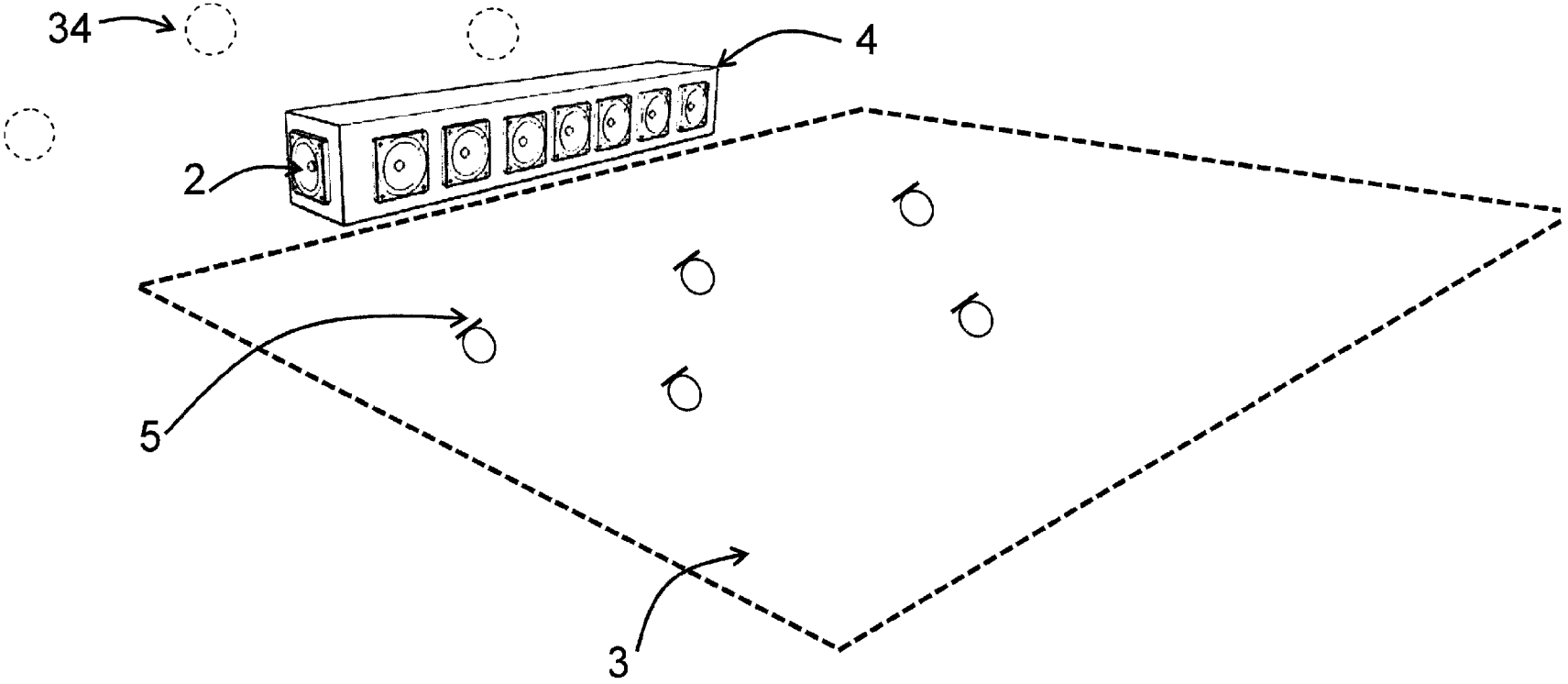

FIG. 7 describes second embodiment according to the invention.

Figure 8:
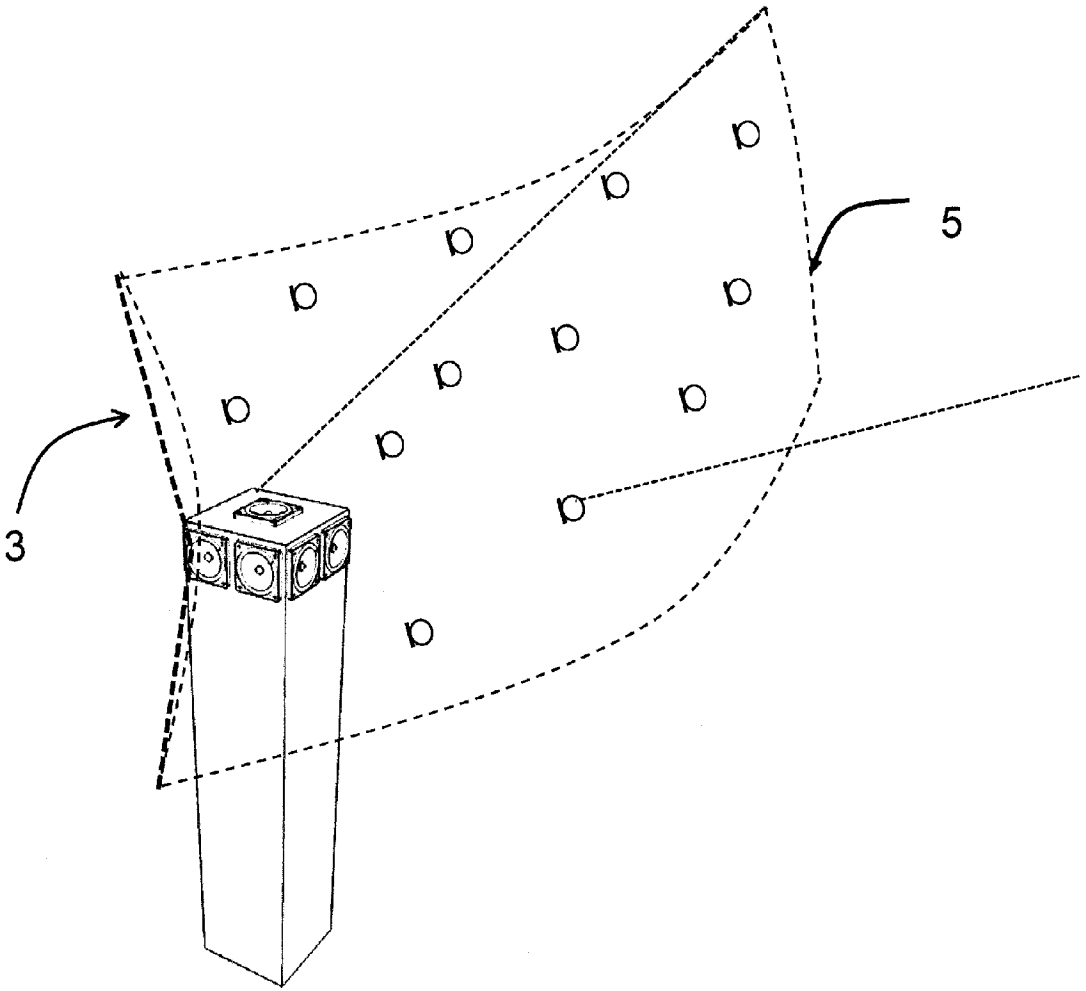

FIG. 8 describes third embodiment according to the invention.

Figure 9:
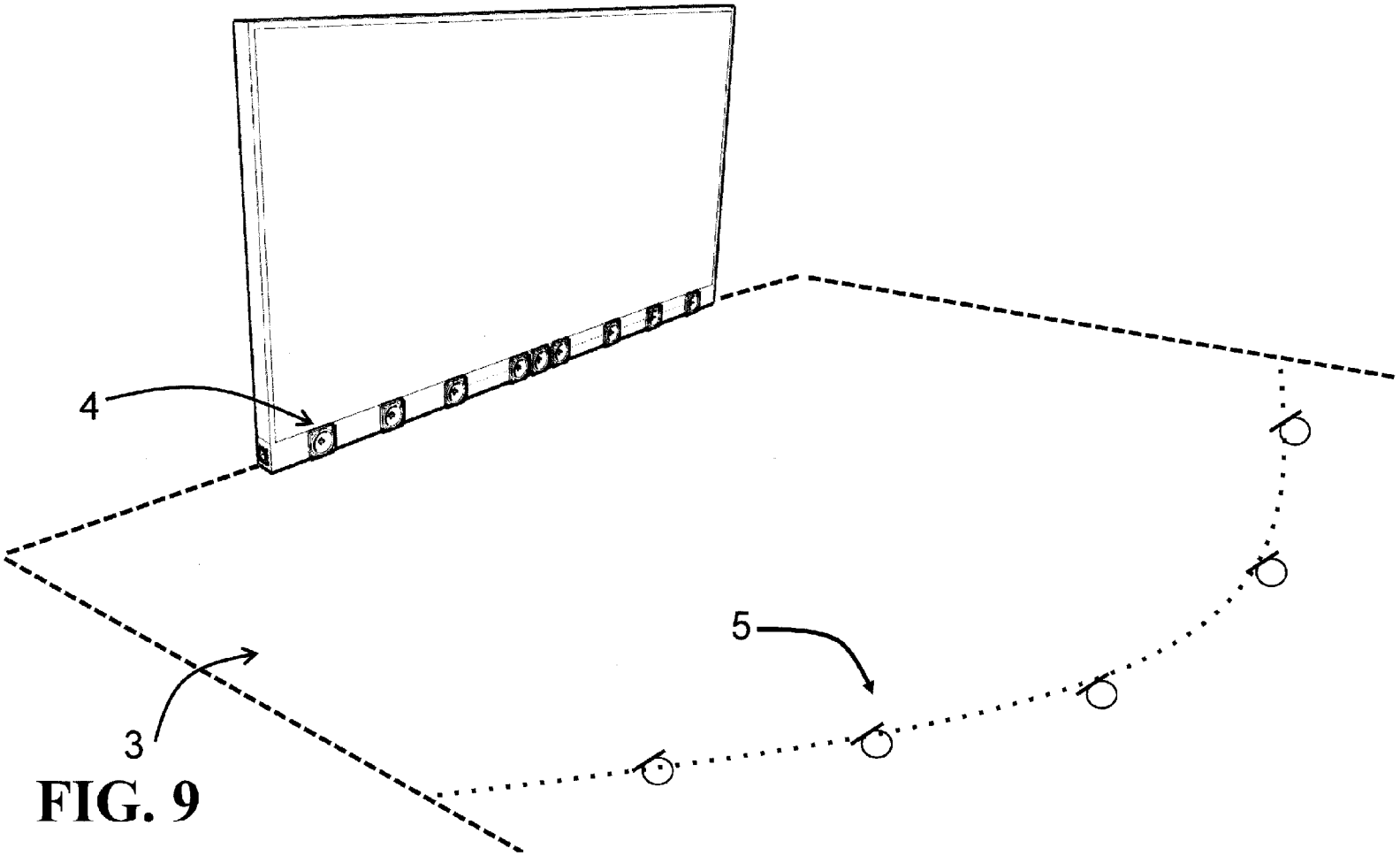

FIG. 9 describes fourth embodiment according to the invention.

DETAILED DESCRIPTION OF FIGURES

FIG. 1-3 were discussed in the introductory part of the specification and is representing the state of the art. Therefore these figures are not further discussed at this stage.

FIG. 4 describes a modified sound field control method according the invention. A conical reproduction surface 22 is defined such that its apex is located within the closed loudspeaker surface 4 and that it encloses the limited reproduction subspace 3. The intersection of the inner volume of the conical reproduction surface 22 and the loudspeaker surface 4 defines a limited loudspeaker surface 23 where loudspeakers 2 should be arranged to form the compact loudspeaker array 19. Similarly, a limited microphone surface 24 is defined as the intersection of the inner volume of the conical reproduction surface 22 and a closed microphone surface 7 that comprises the loudspeaker surface 4.

Loudspeaker alimentation signals 9 are computed from a first audio input signal 21 and first filter coefficients 8 using loudspeaker alimentation signals computation means 15. The loudspeakers 2 emit a sound field 1 that is captured by a plurality of first microphones 5 arranged on the limited microphone surface 24 creating reproduced signals 6. These reproduced signals 6 are compared to target signals 10 forming error signals 14 using error signals computation means 17. The target signals 10 are computed from first audio input signals 21 using target signal computation means 16. The error signals 14 are used to compute filter coefficients 8 so as to minimize the reproduction error. Additionally filter coefficients may be stored in a filter database 20 that comprises filter coefficients 8 optimized for the synthesis of a plurality of target sound fields 11. These filters can thus be used later on for the synthesis of one or several target sound fields 11 from one or several audio input signals 21 using the compact loudspeaker array 19.

FIG. 5 describes an optional second sound field control method according the invention. In this second step, the compact loudspeaker array is positioned in a reflective environment 25. Loudspeaker alimentation signals 9 are computed from a first audio input signal 21 and first filter coefficients 8 extracted from the filter database 20 using loudspeaker alimentation signals computation means 15. The loudspeakers 2 emit a sound field 1 that is captured by a plurality of second microphones 26 creating reproduced signals in reflective environment 27. These reproduced signals in reflective environment 27 are used together with target acoustic power signals in reflective environment 29 in order to calculate acoustic power compensation filter coefficients 31 using acoustic power compensation filter coefficients computation means 30. The target acoustic power signals in reflective environment 29 are computed from first audio input signals 21 using target acoustic power signals in reflective environment computation means 29. The acoustic power compensation filter coefficients 31 are applied first filter coefficients 8 forming second filter coefficients 33 using second filter coefficients computation means 32. Finally, second filter coefficients 33 may be stored in a filter database 20.

Mathematical And Acoustical Foundations

The definition of a reduced loudspeaker and microphone surface using visibility criteria can be justified considering the similarities between WFS and the exterior problem. Both problems can be related to the Kirchhoff Helmholtz integral. The Kirchhoff Helmholtz integral may indeed provide an exact solution of the exterior problem considering a finite size source subspace $\Omega_S$ that comprises all sources that create the target sound field. The target sound field is thus uniquely defined in the reproduction subspace $\Omega_R$ by its pressure and its pressure gradient on the boundary surface $\partial\Omega$ of $\Omega_S$.

However, depending on the shape of $\partial\Omega$, it might be sufficient to describe the target sound field by its pressure only. As disclosed by E. G. Williams in "Fourier Acoustics: Sound Radiation and Nearfield Acoustical Holography", Academic Press Inc (1999) this is the case if $\partial\Omega$ has a spherical shape except at the resonance frequencies of the sphere. Similarly to what has been already disclosed for Wave Field Synthesis, the pressure and the pressure gradient distribution appear as being redundant information when one has to describe a sound field in a subspace using boundary conditions. Furthermore as disclosed by F. Zotter in "Analysis and Synthesis of Sound-Radiation with Spherical Arrays." PhD thesis, Institute of Electronic Music and Acoustics, University of Music and Performing Arts, 2009, the non-uniqueness of the target sound field for pressure description on a sphere is not so problematic when one is considering a finite number of measured points (applying spatial sampling of the surface).

The invention applies simplifications of the required loudspeaker and microphone surfaces that are similar to the simplifications disclosed by Corteel, E. in "Equalization in extended area using multichannel inversion and Wave Field Synthesis", Journal of the Audio Engineering Society, 54, (2006). The selection criteria for loudspeakers and microphones as proposed by the invention are expanded to the general case of 3 dimensional sound field reproduction using compact loudspeaker arrays (i.e. exterior problem). The invention thus provides an accurate control of the emitted sound field within the limited reproduction subspace by controlling the principal components of the emitted sound on the limited microphone surface.

Description Of Embodiments

In a first embodiment of the invention, a plurality of loudspeakers 2 is randomly spread on a vertical planar surface. This embodiment is shown in FIG. 6. The limited reproduction subspace 3 consists in a three-dimensional subspace in front of the loudspeaker surface 4 with similar width and height dimensions than the loudspeaker surface 4. A plurality of microphones 5 is parallel to the loudspeaker surface 4 at a reasonable listening distance. The reproduced signal concentrates the energy in precise zone within the limited reproduction subspace, giving a particular directivity pattern to the virtual source 34. This embodiment can be used for sound installations in museums or theme parks.

In a second embodiment of the invention, a plurality of loudspeakers 2 is linearly distributed with one or several additional loudspeakers on each side of the line. This embodiment is shown in FIG. 7. The limited reproduction subspace 3 consists in a half horizontal plane in front of the loudspeaker surface 4. A plurality of microphones 5 is located in the same horizontal plane as the limited reproduction subspace 3. The target sound field 11 can be composed of virtual sources 34 with different position. Possible applications of this embodiment can be found in hifi audio systems.

In a third embodiment of the invention, a plurality of loudspeakers 2 is distributed on an upper frontal quarter pseudo-spherical array mounted on top of a pilar. This embodiment is shown in FIG. 8. The limited reproduction subspace 3 is the upper frontal quarterfield starting at the loudspeakers' height. The first microphones 5 are distributed on an upper frontal quarter sphere surface centered on the middle point between all loudspeakers 2. The target sound field consists in directive virtual sources that are directed to opposite sides or upward so that they reach the listener reflecting on the walls and ceiling of the listening room. The embodiment simultaneously reproduces various beams from multiple audio input signals (multichannel sound) while expanding the perceived width of sound reproduction device.

In a fourth embodiment of the invention, a plurality of loudspeakers 2 is integrated in the lower front part of a screen. One or several loudspeakers are also integrated in the lower side part of the screen. This embodiment is shown in FIG. 9. The limited reproduction subspace 3 is the half horizontal plane located in front of the loudspeaker surface 4. A plurality of microphones 5 is located on a quarter circle in the same frontal horizontal plane as the limited reproduction subspace. It should account for the common positioning of users looking at the screen.

This embodiment aims at sound reinforcement for any screen applications such as TV, virtual reality environments, cinema or laptops. The embodiment can reproduce various virtual sources, which allows providing usual multichannel sound format used for screen applications such as 2.1 or 5.1.

Applications of the invention are including but not limited to the following domains: hifi sound reproduction, home theatre, cinema, concert, shows, interior noise simulation for an aircraft, sound reproduction for Virtual Reality, sound reproduction in the context of perceptual unimodal/cross-modal experiments.

Although the foregoing invention has been described in some detail for the purposes of clarity of understanding, it will be apparent that certain changes and modifications may be practiced within the scope of the appended claims. Accordingly, the present embodiments are to be considered as illustrative and not restrictive, and the invention is not limited to the details given herein, but may be modified with the scope and equivalents of the appended claims.

The invention claimed is:

1. A method for optimizing design and sound field control of a sound reproduction device comprising a plurality of loudspeakers located on a surface of the sound reproduction device forming a closed loudspeaker surface, said method comprising the steps of:

controlling an emitted sound field by said plurality of loudspeakers within a limited reproduction subspace by capturing said sound field using a plurality of microphones located on a closed microphone surface enclosing a closed loudspeaker surface and adjusting filter coefficients for modifying alimentation signals of said plurality of loudspeakers for reproducing a target sound field;

defining a conical reproduction surface enclosing the limited reproduction sub-space so such that an apex of said conical reproduction surface is comprised within or behind the closed loudspeaker surface;

defining a closed microphone surface comprising the apex of the conical reproduction surface and the closed loudspeaker surface;

positioning said plurality of loudspeakers on a limited loudspeaker surface defined by an intersection of an inner volume of the conical reproduction surface and the closed loudspeaker surface;

positioning said plurality of microphones on a limited microphone surface defined by the intersection of the inner volume of the conical reproduction surface and the closed microphone surface;

capturing the sound field radiated by said plurality of loudspeakers located at fixed positions on the limited loudspeaker surface using said plurality of microphones located at fixed positions on a limited microphone surface; and, adjusting said filter coefficients for modifying the alimentation signals of said plurality of loudspeakers for minimizing a difference between reproduced signals captured by said plurality of microphones and target signals describing said target sound field within the limited reproduction subspace.

2. The method for optimizing design and sound field control of a sound reproduction device according to claim 1, further comprising the step of:

obtaining the reproduced signals using a physical measurement for capturing a free field radiation of said plurality of loudspeakers.

3. The method for optimizing design and sound field control of a sound reproduction device according to claim 1, further comprising the step of:

obtaining the reproduced signals used a model for characterizing a free field radiation of said plurality of loudspeakers.

4. The method for optimizing design and sound field control of a sound reproduction device according to claim 1, wherein said plurality of microphones are arranged for providing an aliasing-free description of said sound field in said limited reproduction subspace up to a corner frequency.

5. The method for optimizing design and sound field control of a sound reproduction device according to claim 1, wherein said plurality of loudspeakers are arranged for providing an aliasing-free synthesis of said sound field in said limited reproduction subspace up to a corner frequency.

6. The method for optimizing design and sound field control of a sound reproduction device according to claim 1, wherein said filter coefficients are first filter coefficients and are modified by accounting for acoustic power radiated by said sound reproduction device for synthesizing the target sound field forming second filter coefficients that compensate for a difference between an estimated acoustic power radiated by the sound reproduction device for the synthesis of the target sound field to an estimate of acoustic power of the target sound field for accounting for sound field radiated by said plurality of loudspeakers via said sound reproduction device out of the limited reproduction subspace.

7. The method for optimizing design and sound field control of a sound reproduction device according to claim 6, further comprising the step of:

estimating the acoustic power radiated by the sound reproduction device for the synthesis of the target sound field by positioning said plurality of loudspeakers in a reflective environment and capturing reproduced signals in the reflective environment with a plurality of additional microphones.

8. The method for optimizing design and sound field control of a sound reproduction device according to claim 6, further comprising the step of:

estimating the acoustic power radiated by the sound reproduction device for the synthesis of the target sound field by using a model of radiation for said plurality of loudspeakers.

9. The method for optimizing design and sound field control of a sound reproduction device according to claim 6, further comprising the step of:

obtaining the second filter coefficients by applying acoustic power correction filter coefficients to the first filter coefficients.

* * * * *